US006872293B2

(12) United States Patent
Carruba

(10) Patent No.: US 6,872,293 B2
(45) Date of Patent: Mar. 29, 2005

(54) ELECTROKINETIC FLUID EJECTION

(75) Inventor: Frank R. Carruba, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 409 days.

(21) Appl. No.: 10/001,493

(22) Filed: Oct. 31, 2001

(65) Prior Publication Data

US 2003/0079991 A1 May 1, 2003

(51) Int. Cl.[7] ..... C25B 13/00
(52) U.S. Cl. ..... 204/600; 204/252
(58) Field of Search ..... 204/600, 252, 204/450; 251/129.01, 129.06

(56) References Cited

U.S. PATENT DOCUMENTS 5,325,880 A * 7/1994 Johnson et al. ..... 137/1
5,671,905 A * 9/1997 Hopkins, Jr. ..... 251/129.01
6,019,882 A 2/2000 Paul et al. ..... 204/450
6,309,043 B1 * 10/2001 Lerat et al. ..... 347/21

* cited by examiner

*Primary Examiner*—Kishor Mayekar

(57) ABSTRACT

Electrokinetic fluid ejection is disclosed. A mechanism includes a sealed quantity of electrolytic solution, a measured quantity of fluid, and a membrane. The membrane is exposed to the electrolytic solution on one side, and exposed to fluid on another side. An electric potential applied to the electrolytic solution excites the solution, causing the membrane to discharge a droplet of fluid. This can be accomplished by the electrical potential pressuring the electrolytic solution, displacing the membrane and thus the fluid. This can also be accomplished by the electrical potential transferring energy to the solution, which transfers energy to the membrane. Energy is then transferred from the membrane to the fluid. The invention can be used as a manner by which inkjet printing is accomplished.

24 Claims, 5 Drawing Sheets

ELECTROKINETIC FLUID EJECTION

FIELD OF THE INVENTION

This invention relates generally to fluid ejection, such as printing on media by printers, and more specifically to fluid ejection in an electrokinetic manner.

BACKGROUND OF THE INVENTION

Inkjet printers have become increasingly inexpensive and increasingly popular. A typical inkjet printer usually has a number of common components, regardless of its brand, speed, and so on. There is a print head that contains a series of nozzles used to spray droplets of ink onto paper. Ink cartridges, either integrated into the print head or separate therefrom, supply the ink. There may be separate black and color cartridges, color and black in a single cartridge, a cartridge for each ink color, or a combination of different colored inks in a given cartridge. A print head motor typically moves the print head assembly back and forth horizontally, or laterally, across the paper, where a belt or cable is used to attach the assembly to the motor. Other types of printer technologies use either a drum that spins the paper around, or mechanisms that move the paper rather than the print head. The result is the same, in that the print head is effectively swept across the paper linearly to deposit ink on the paper. Rollers pull paper from a tray, feeder, or the user's manual input, and advance the paper to new vertical locations on the paper.

In general, there are two broad classes of inkjet printers: continuous-ink inkjet printers, and drop-on-demand inkjet printers. The earliest inkjet printers were continuous-ink printers. With this type of inkjet printer, a continuous stream of ink droplets is sprayed. Deflection plates are used to cause the ink to either reach the media, or drop in a return gutter. The inkjet nozzle typically uses a piezoelectric crystal to synchronize the droplets, and a charging tunnel selectively charges the droplets that are deflected into the return gutter. Other droplets reach the media. Most inkjet printers today, however, use the drop-on-demand approach, which forces a droplet of ink out of a chamber by heat or electricity. The thermal method is used by some manufacturers, in which a resistor is heated that forces a droplet of ink out of the nozzle by creating an air bubble in the ink chamber. By comparison, the electric approach employed by other manufacturers uses a piezoelectric element that charges crystals that expand and jet the ink onto the media.

Existing inkjet printers, however, can sometimes be susceptible to failure in their print head mechanisms that contain the inkjet nozzles. In the case of thermal ink droplet ejection, the heat must be precisely controlled to ensure proper printing. However, the use of heat can be unpredictable, in that ink bubbles and other undesirable artifacts may occur. The heat itself must also be taken into account when designing the nozzles and the other components of the print head mechanisms, because the heat can cause these components to fail. Cooling mechanisms may thus be necessary to ensure the prolonged life of the print head mechanisms. In the case of electric ink droplet ejection, the electrical components are typically in direct contact with the ink, which can render the components prone to failure. For these and other reasons, therefore, there is a need for the present invention.

SUMMARY OF THE INVENTION

The invention relates to electrokinetic fluid ejection. A mechanism includes a sealed quantity of electrolytic solution, a measured quantity of fluid, and a membrane. The membrane is exposed to the electrolytic solution on one side, and exposed to fluid on another side. An electric potential applied to the electrolytic solution excites the solution, causing the membrane to discharge a droplet of fluid. Still other aspects, advantages, and embodiments of the invention will become apparent by reading the detailed description that follows, and by referencing the accompanying drawings.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. Whereas the invention is substantially described in the detailed description in relation to inkjet printing, it is applicable to other types of printing more generally, as well as to other types of fluid ejection. The following detailed description is, therefore, not to be taken in a limiting sense, and the scope of the present invention is defined only by the appended claims.

Electrokinetic Inkjet Printer Print Head Mechanism

Figure 1:
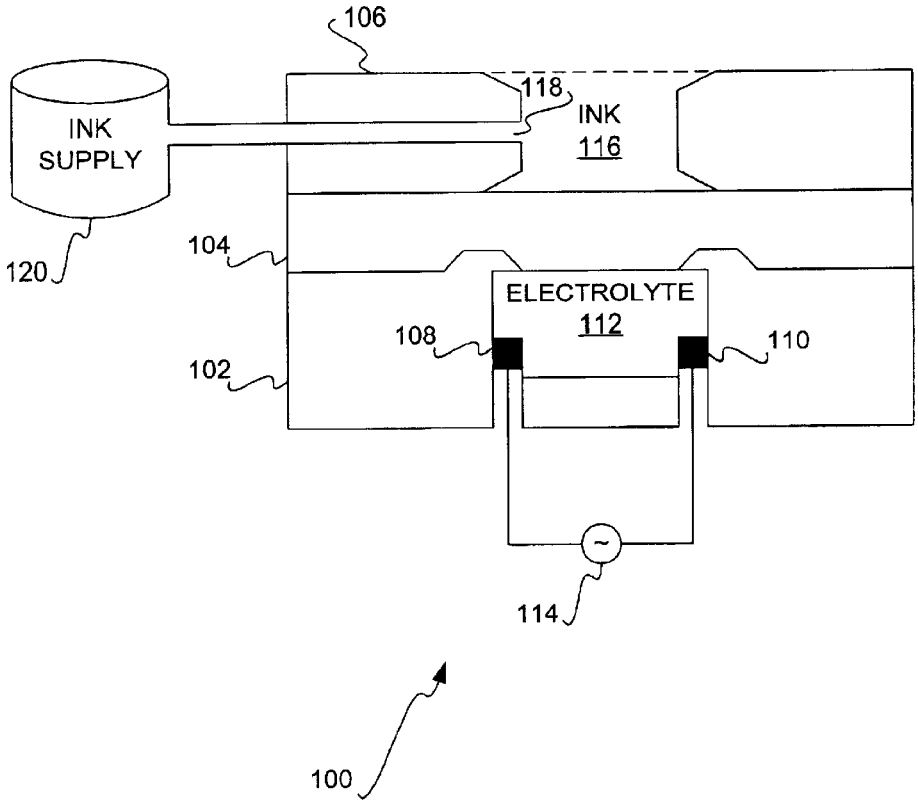
FIG. 1 is a diagram showing an electrokinetic inkjet printer print head mechanism according to an embodiment of the invention.

FIG. 1 shows the cross-sectional side profile of an electrokinetic inkjet printer print head mechanism 100 according to an embodiment of the invention. The mechanism 100 is for one color of ink, and typically there are other similar mechanisms for other colors of ink. For example, there may be a mechanism 100 for each of the ink colors cyan, yellow, magenta, and black. Furthermore, the mechanism 100 may be part of an inkjet printer nozzle installed in an inkjet printer print head assembly, either with or without an adjoining ink cartridge to supply the ink.

The mechanism 100 includes a die 102, a membrane 104, and a nozzle plate 106. The die 102 is preferably a silicon die, and encases or holds a quantity of electrolytic solution 112 in a cavity of the die 102. The die 102 also encases a pair of electrodes 108 and 110, over which a potential is applied via a power source 114. The electrolytic solution 112 is preferably sealed, by both the die 102 and one side of the membrane 104. The electrolytic solution 112 can be interchangeably referred to as an electrolytic fluid, or an electrolytic liquid. Preferably, the electrolytic solution 112 exhibits the capability for electro-osmotic flow, such that placing a charge across the pair of electrodes 108 causes a force to be exerted on the solution 112.

The membrane 104 is preferably thin, flexible, and deformable. The membrane 104 can be constructed from a polyester film, such as a Mylar polyester film, available from DuPont Teijin Films, LP, of Wilmington, Del. The membrane 104 also may be constructed from a polyimide film, such as a Kapton polyimide film, available from DuPont High Performance Materials, of Circleville, Ohio. The membrane 104 can be constructed from a fiber material, such as a Kevlar fiber material, available from DuPont Advanced Fibers Systems, of Richmond, Va. The membrane 104 can also be constructed from another material.

The membrane 104 is situated between the die 102 and the nozzle plate 106. The nozzle plate 106 is more generally a plate, and is preferably constructed by an injection-molding process, which ensures that the plate 106 is free of bubbles and debris. For example, the nozzle plate 106 may be constructed from a microstructure available from American Laubscher Corp., of Farmingdale, N.Y. The nozzle plate 106 holds a measured quantity of ink 116 in a cavity of the plate 106. An inlet 118 in the nozzle plate 106 allows a supply of ink 120 to replenish the measured quantity of ink 116. The quantity of ink 116 can be measured in that it is enough ink for one or another number of ink droplets to be ejected from the nozzle plate 106.

In general operation of the inkjet printer print head mechanism 100, when the mechanism 100 is required to eject a droplet of ink on a media (not shown in FIG. 1), the power source 114 applies a potential between the pair of electrodes 108 and 110. The potential excites the electrolytic solution 112, which in turn causes the membrane 104 to eject a droplet of the ink 116 onto the media. Once this has occurred, the ink supply 120 replenishes the measured quantity of ink 116 as necessary, so that another droplet of the ink 116 can be ejected onto the media.

More specifically, the print head mechanism 100 can operate in one of at least two ways. First, the potential applied between the pair of electrodes 108 and 110 may pressurize the electrolytic solution 112, causing the membrane 104 to eject a droplet of the ink 116. Second, the potential applied between the pair of electrodes 108 and 110 may transfer energy to the electrolytic solution 112, which transfers energy to the membrane 104 and then to the ink 116, causing a droplet of the ink 116 to be ejected. Each of these manners of operations is now described in more detail.

Electrolytic Solution Pressurization for Ink Droplet Ejection

Figure 2:
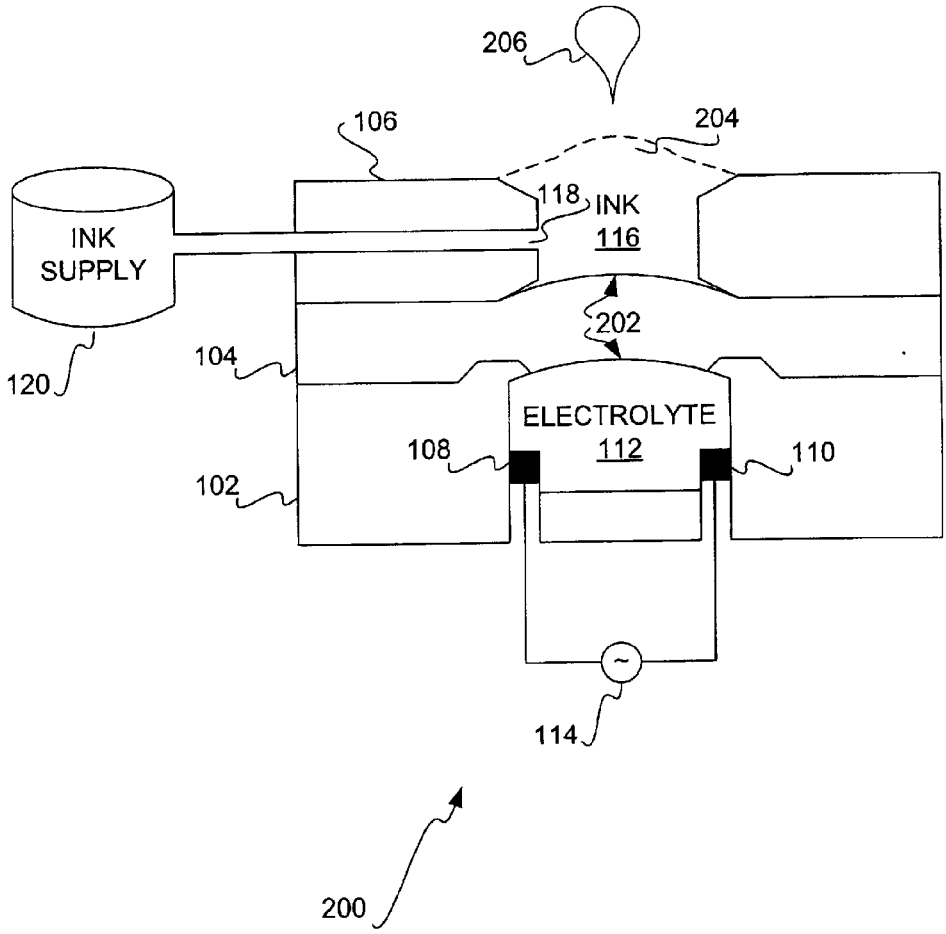
FIG. 2 is a diagram showing one manner of operation by which an electrokinetic inkjet printer print head mechanism can eject a droplet of ink onto media, according to an embodiment of the invention.

FIG. 2 shows the cross-sectional side profile of an inkjet printer print head mechanism 200 according to an embodiment of the invention in which the electrolytic solution 112 is pressurized to ultimately cause ink droplet ejection. Components of the print head mechanism 200 that are like-numbered as compared to components of the print head mechanism 100 of FIG. 1 are identical to their correspondingly numbered components of the mechanism 100 of FIG. 1. Therefore, description of these components of the print head mechanism 200 is omitted except for the particular manner by which they operate to cause ink jet droplet ejection in this embodiment of the invention.

When the power source 114 applies a potential between the pair of electrodes 108 and 110, the electrolytic solution 112 is excited and pressurized. For example, the pressure of the solution 112 may exceed 2500 pounds per square inch (psi). This extreme pressure in turn displaces the membrane 104, as indicated by the reference number 202, where the membrane 104 bulges upwards from the pressure of the electrolytic solution 112. Displacement of the membrane 104 correspondingly displaces the ink 116, as indicated by the reference number 204, where the ink 116 bulges upwards from the pressure of the membrane 104. The displacement of the membrane 104 and of the ink 116 causes a droplet of ink 206 to break free from the ink 116, such that the droplet of ink 206 is ejected from the print head mechanism 200.

Electrolytic Solution Energy Transfer for Ink Droplet Ejection

Figure 3:
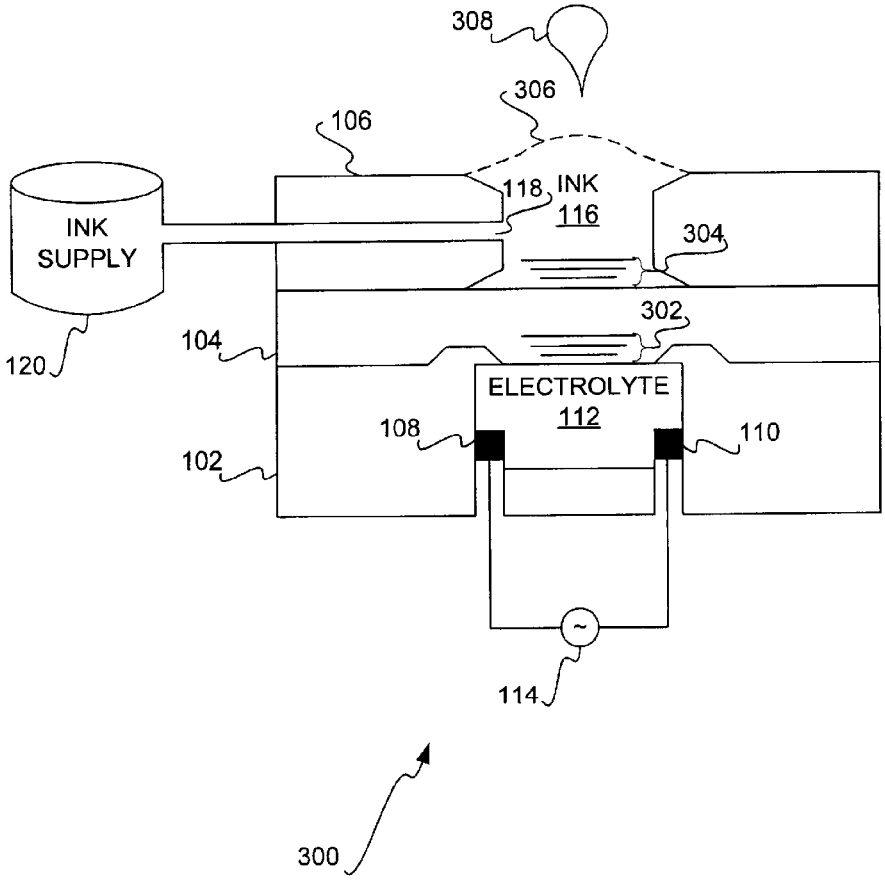
FIG. 3 is a diagram showing another manner of operation by which an electrokinetic inkjet printer print head mechanism can eject a droplet of ink onto media, according to an embodiment of the invention.

FIG. 3 shows the cross-sectional side profile of an inkjet printer print head mechanism 300 according to an embodiment of the invention in which the electrolytic solution 112 both has energy transferred thereto and transfers energy to ultimately cause ink droplet ejection. Components of the print head mechanism 300 that are like-numbered as compared to components of the print head mechanism 100 of FIG. 1 are identical to their correspondingly numbered components of the mechanism 100 of FIG. 1. Therefore, description of these components of the print head mechanism 300 is omitted except for the particular manner by which they operate to cause ink jet droplet ejection in this embodiment of the invention.

When the power source 114 applies a potential between the pair of electrodes 108 and 110, the electrolytic solution 112 is excited, by the energy transferred to the solution from the electrodes 108 and 110. This excitation of the solution 112 in turn transfers energy to the membrane 104, as indicated by the lines 302. The energy transfer may be in the form of a shock wave, for example. The energy transferred to the membrane 104 is then transferred to the ink 116, as indicated by the lines 304, and may also be in the form of a shock wave. The energy transferred to the ink 116 causes the ink 116 to bulge upward, as indicated by the reference number 306. The energy transfer from the electrolytic solution 112 to the membrane 104, and from the membrane 104 to the ink 116, causes a droplet of ink 308 to break free from the ink 116, such that the droplet of ink 308 is ejected from the print head mechanism 300.

Overall Method

Figure 4:
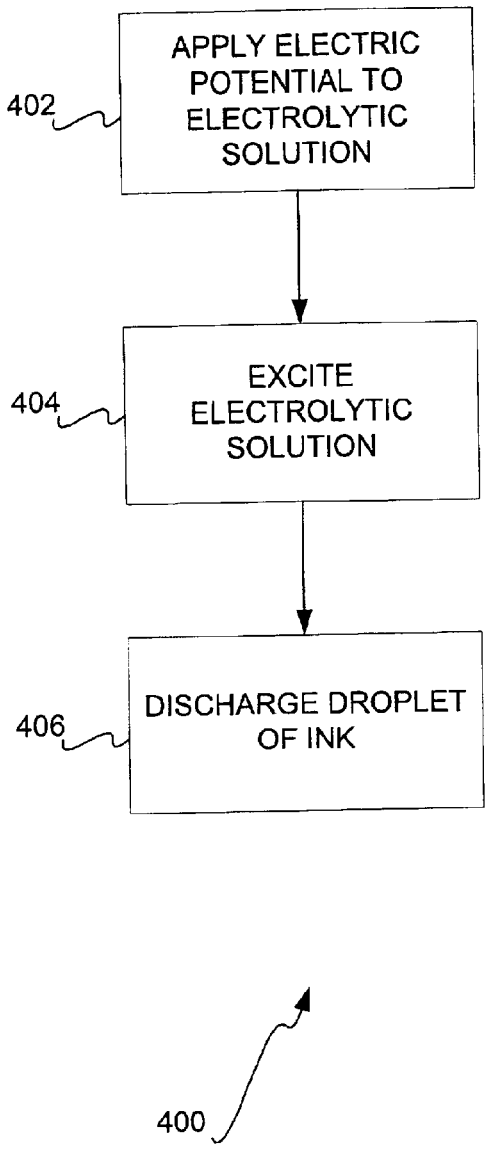
FIG. 4 is a flowchart of the overall method that is performed to electrokinetically eject a droplet of ink onto media, according to an embodiment of the invention.

FIG. 4 shows a method 400 of the basic process performed by an embodiment of the invention to electrokinetically eject droplets of ink onto media by an electrokinetic print head mechanism. The method 400 can be performed in conjunction with any of the print head mechanisms 100, 200, and 300, of FIGS. 1, 2, and 3, respectively, that have been described. The method 400 may also be performed in conjunction with other print head mechanisms.

An electric potential is first applied to a sealed quantity of electrolytic solution (402). The electrolytic solution is preferably sealed in part by one side of a membrane, where the other side of the membrane is exposed to a measured quantity of ink. The electric potential may be applied by a separated pair of electrodes, as has been described. The electric potential excites the electrolytic solution (404). This results in the membrane discharging a droplet of ink from the measured quantity of ink onto the media (406). The entire measured quantity of ink, or only a part thereof, may be discharged as the droplet of ink.

Discharging the droplet of ink can be accomplished in one of at least two ways, as has been described in detail. First, the electrolytic solution may be pressurized as result of the electric potential applied to the solution, which displaces the membrane, and correspondingly displaces the measured quantity of ink to discharge the ink droplet. Second, energy may be transferred from the electrolytic solution to the membrane as a result of the electric potential applied to the solution, which is then transferred from the membrane to the measured quantity of ink, causing the ink droplet to be discharged.

Example Printer

Figure 5:
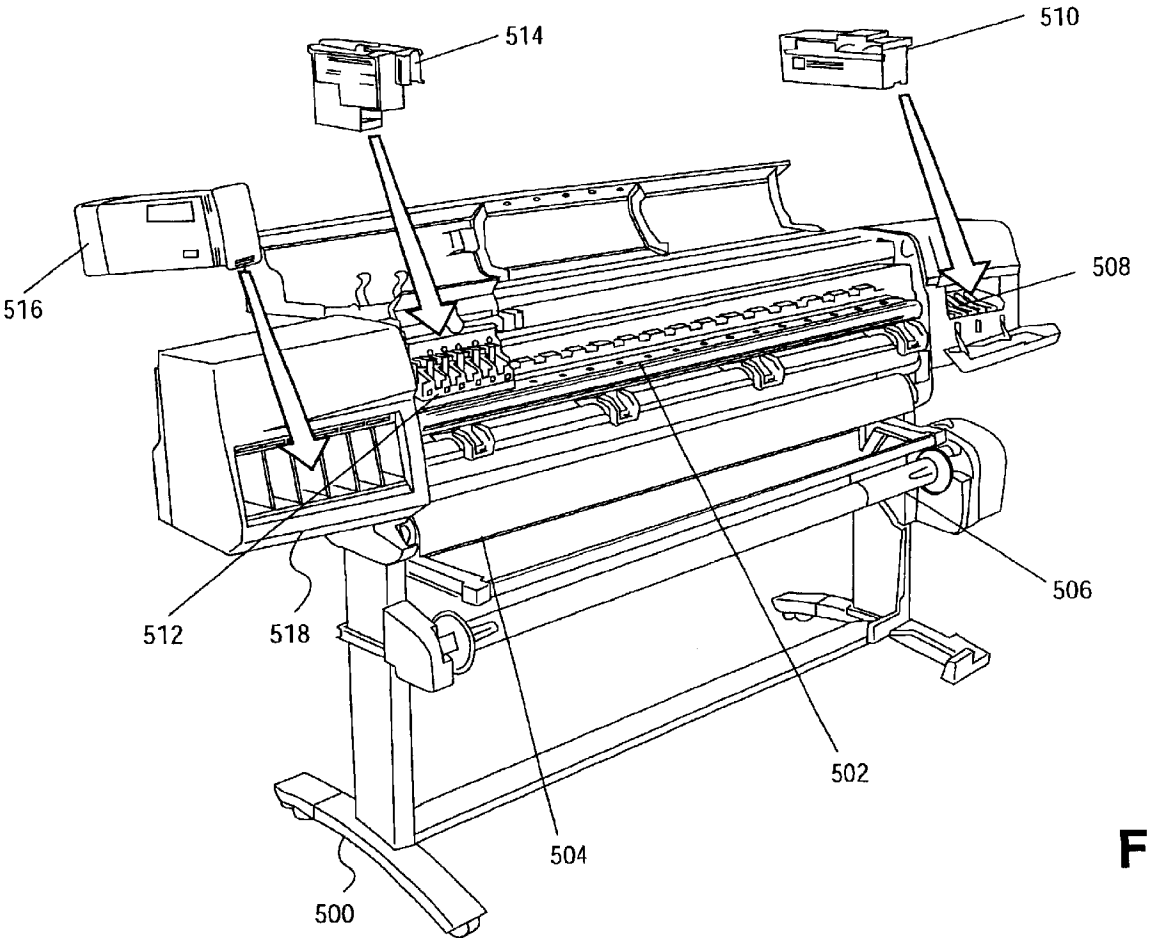
FIG. 5 is a diagram of an example printer in conjunction with which an electrokinetic inkjet printer print head mechanism according to an embodiment of the invention can be implemented. The printer of FIG. 5 is meant as an example only, and embodiments of the invention can also be implemented in conjunction with other printers.

FIG. 5 shows an example wide-format inkjet printer 500 in conjunction with which embodiments of the invention may be implemented. Other, smaller-format inkjet printers, such as those more typically found in home and office environments, may also be implemented in conjunction with embodiments of the invention. The printer 500 includes a platen 502, a media roll 504, and a take-up roll 506 for the media. A service station 508 is situated on one side of the printer 500 for insertion of a corresponding print head cleaner 510, which cleans the print heads. The media roll 504 and the take-up roll 506 constitute a media-feeding mechanism to advance media vertically through the printer 500.

A carriage assembly 512, has inserted thereinto one or more print heads, such as the print head 514, where each print head includes an inkjet nozzle for a corresponding ink color. Any of the print heads can be or include any of the print head mechanisms 100, 200, and 300, of FIGS. 1, 2, and 3, respectively, that have been described. A motor, not shown in FIG. 5, advances the carriage assembly 512, including the print heads, horizontally or laterally over the media. Finally, ink cartridges, such as the ink cartridge 516, are inserted into the ink station 518. The assembly 512 moves horizontally to the station 518 for its print heads to obtain a supply of ink stored by the ink cartridges. In other types of inkjet printers, the ink cartridges may be inserted into the carriage assembly 512 itself, in corresponding print heads. Furthermore, the ink cartridges may be integrated into the print heads themselves in such printers.

Conclusion

Embodiments of the invention provide for advantages over the prior art. Unlike inkjet printers that use heat to eject droplets of ink, embodiments of the invention do not, so printer malfunction due to heat is avoided. Furthermore, the electrolytic solution and the pair of electrodes are preferably sealed, and isolated from the ink by the membrane. As a result, electrical malfunction due to the ink coming into contact with the electrical components of an inkjet printer is avoided, in distinction to prior art inkjet printers that use electricity to eject droplets of ink.

It is noted that, although specific embodiments have been illustrated and described herein, it will be appreciated by those of ordinary skill in the art that any arrangement is calculated to achieve the same purpose may be substituted for the specific embodiments shown. For instance, whereas the invention has been substantially described in relation to ink, it is applicable to other types of fluid as well. This application is intended to cover any adaptations or variations of the present invention. Therefore, it is manifestly intended that this invention be limited only by the claims and equivalents thereof.

I claim:

1. A mechanism comprising:

a sealed quantity of electrolytic solution;

a measured quantity of fluid; and, a membrane exposed to the electrolytic solution on one side and exposed to the fluid on another side, the membrane adapted to cause a droplet of the fluid to be discharged in response to an electric potential applied in the electrolytic solution and that excites the electrolytic solution.

2. The mechanism of claim 1, further comprising a die encasing the electrolytic solution.

3. The mechanism of claim 2, further comprising a separated pair of electrodes encased with the electrolytic solution by the die, the electrodes adapted to apply the wherein an electric potential applied to the electrolytic solution such that the electrolytic solution becomes excited.

4. The mechanism of claim 3, further comprising a power source to apply the electric potential between the electrodes.

5. The mechanism of claim 2, wherein the die comprises a silicon die.

6. The mechanism of claim 1, further comprising a nozzle plate over the membrane and holding the measured quantity of fluid.

7. The mechanism of claim 6, further comprising a fluid supply providing the measured quantity of fluid through an inlet in the nozzle plate.

8. The mechanism of claim 6, wherein the nozzle plate is an injection-molded nozzle plate.

9. The mechanism of claim 1, wherein the membrane is a thin and flexible membrane.

10. The mechanism of claim 1, wherein the electric potential applied to the electrolytic solution pressurizes the electrolytic solution, displacing the membrane, which displaces the fluid, discharging the droplet of the fluid.

11. The mechanism of claim 1, wherein the electric potential applied to the electrolytic solution transfers energy from the electrolytic solution to the membrane, which transfers the energy to the fluid, discharging the droplet of the fluid.

12. The mechanism of claim 11, wherein the energy is transferred from the electrolytic solution to the membrane and from the membrane to the fluid via a shock wave.

13. A mechanism comprising:

a sealed quantity of electrolytic solution;

a quantity of fluid;

a membrane exposed to the electrolytic solution on one side and exposed to the fluid on another side; and, means for exciting the electrolytic solution resulting in the membrane causing a droplet of the fluid to be discharged.

14. The mechanism of claim 13, wherein the means excites the electrolytic solution by applying an electric potential to the electrolytic solution.

15. The mechanism of claim 14, wherein the electric potential applied to the electrolytic solution pressurizes the electrolytic solution, displacing the membrane, which displaces the fluid, discharging the droplet of the fluid.

16. The mechanism of claim 14, wherein the electric potential applied to the electrolytic solution transfers energy from the electrolytic solution to the membrane, which transfers the energy to the fluid, discharging the droplet of the fluid.

17. The mechanism of claim 16, wherein the energy is transferred from the electrolytic solution to the membrane and from the membrane to the fluid via a shock wave.

18. A mechanism comprising:

a sealed quantity of electrolytic solution;

a quantity of fluid;

a flexible material comprising a first side in contact with the electrolytic solution and a second side in contact with the fluid; and, a mechanism to apply an electric potential to the electrolytic solution that excites the electrolytic solution, resulting in the membrane causing a droplet of the fluid to be discharged.

19. The mechanism of claim 18, wherein the mechanism comprises a separated pair of electrodes encased within the electrolytic solution the electrodes adapted to apply the electric potential to the electrolytic solution such that the electrolytic solution becomes excited.

20. The mechanism of claim 18, wherein the electric potential applied to the electrolytic solution pressurizes the electrolytic solution, displacing the membrane, which displaces the fluid, discharging the droplet of the fluid.

21. The mechanism of claim 18, wherein the electric potential applied to the electrolytic solution transfers energy from the electrolytic solution to the membrane, which transfers the energy to the fluid, discharging the droplet in the fluid.

22. The mechanism of claim 21, wherein the energy is transferred from the electrolytic solution to the membrane and from the membrane to the fluid via a shock wave.

23. The mechanism of claim 18, further comprising a die encasing the electrolytic solution.

24. The mechanism of claim 23, wherein the die comprises a silicon die.

* * * * *